US011726419B2

(12) United States Patent
Matsuura

(10) Patent No.: US 11,726,419 B2
(45) Date of Patent: Aug. 15, 2023

(54) IMAGE FORMING APPARATUS

(71) Applicant: CANON KABUSHIKI KAISHA, Tokyo (JP)

(72) Inventor: Taisuke Matsuura, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/700,811

(22) Filed: Mar. 22, 2022

(65) Prior Publication Data

US 2022/0317599 A1 Oct. 6, 2022

(30) Foreign Application Priority Data

Mar. 31, 2021 (JP) ..... 2021-059835

(51) Int. Cl.
*G03G 15/16* (2006.01)
*G03G 15/00* (2006.01)

(52) U.S. Cl.
CPC ..... *G03G 15/1675* (2013.01); *G03G 15/5016* (2013.01); *G03G 15/5037* (2013.01); *G03G 15/5041* (2013.01); *G03G 15/5058* (2013.01); *G03G 15/5062* (2013.01)

(58) Field of Classification Search
CPC ..... G03G 15/1675; G03G 15/5016; G03G 15/502; G03G 15/5062
See application file for complete search history.

(56) References Cited

U.S. PATENT DOCUMENTS 8,843,003 B2 9/2014 Nakao
11,126,115 B2 9/2021 Sueoka
11,137,709 B2 10/2021 Kohno et al.
2017/0097593 A1* 4/2017 Itagaki ..... G03G 15/1675
2018/0270381 A1* 9/2018 Ikuta ..... H04N 1/00896
2020/0242426 A1 7/2020 Omata
2020/0285176 A1* 9/2020 Sueoka ..... G03G 15/5058
2020/0409299 A1* 12/2020 Kohno ..... G03G 15/5054

FOREIGN PATENT DOCUMENTS

JP 2013-037185 A 2/2013
JP 2020-118931 A 8/2020
JP 2020-144289 A 9/2020
JP 2021-009212 A 1/2021

OTHER PUBLICATIONS

Taisuke Matsuura, U.S. Appl. No. 17/585,062, filed Jan. 26, 2022.

* cited by examiner

*Primary Examiner* — Carla J Therrien
(74) *Attorney, Agent, or Firm* — Venable LLP

(57) ABSTRACT

An image forming apparatus includes an image forming portion, an image bearing member, a transfer member, a voltage source, a density detecting portion, a display portion, a controller, and an operating portion. The controller is capable of executing an operation in a mode in which a test chart for adjusting a transfer voltage is outputted, and setting information on the transfer voltage set for during transfer on the basis of a detection result when the test chart is detected by the detecting portion is displayed at the display portion and is checked by user. The controller causes the display portion to display setting information on the basis of a correcting value and causes the user to check the setting information in the operation in the mode executed after the correcting value is inputted from the operating portion.

6 Claims, 10 Drawing Sheets

IMAGE FORMING APPARATUS

FIELD OF THE INVENTION AND RELATED ART

The present invention relates to an image forming apparatus for outputting a chart for adjusting a transfer voltage.

In the image forming apparatus, a toner image is transferred from a photosensitive drum onto a recording material directly or via an intermediary transfer belt. For this reason, a transfer member for forming a transfer portion for transferring the toner image between itself and the photosensitive drum or between itself and the intermediary transfer belt is provided. Further, a type for appropriately setting a transfer voltage applied to the transfer portion during image formation has been conventionally known.

For example, in Japanese Laid-Open Patent Application (JP-A) 2013-37185, a type (adjustment mode of secondary transfer voltage) in which a plurality of pattern images transferred with different transfer voltages are outputted, and on the basis of the pattern image, an optimum transfer voltage is selected and is reflected in the transfer voltage during the image formation is disclosed. Further, in JP-A 2013-37185, an operation in a mode in which an optimum secondary transfer voltage is automatically selected on the basis of density data acquired by causing a reading device to read the outputted pattern images is capable of being executed.

However, in the case of the operation in the mode disclosed in JP-A 2013-37185 in which the optimum secondary transfer voltage is automatically selected, as the automatically selected secondary transfer voltage, a value based on a selection standard determined in advance in the image forming apparatus is selected. For this reason, depending on user preference in transfer image quality, the case where the user desires to make a set value larger or smaller than an automatically selected value can arise. In that case, it would be considered that the automatically selected value is manually inputted again every occasion. However, in the case where every occasion when the above-described operation in the mode is carried out, the user performs an operation in which the user manually selects a desired value again, an adjustment operation time of the secondary transfer voltage increases, so that operation efficiency lowers.

SUMMARY OF THE INVENTION

A principal object of the present invention is to provide an image forming apparatus capable of enhancing efficiency of adjustment of a transfer voltage.

An aspect of the present invention is to provide an image forming apparatus comprising an image forming portion configured to form a toner image; an image bearing member configured to bear the toner image formed by the image forming portion; a transfer member configured to transfer the toner image from the image bearing member onto a recording material; a voltage source configured to apply a transfer voltage to the transfer member; a density detecting portion configured to detect information on a density of an image formed on the recording material; a display portion capable of displaying information; a controller capable of executing an operation in a mode in which a test chart for adjusting the transfer voltage is outputted, and setting information on the transfer voltage set for during transfer on the basis of a detection result when the test chart is detected by the detecting portion is displayed at the display portion and is checked by user, wherein the test chart is formed by transferring a predetermined test image from the image bearing member onto the recording material under application of a plurality of different test voltages to the transfer member; and an operating portion to which a correcting value for correcting the setting information displayed at the display portion can be input, wherein the controller causes the display portion to display the setting information on the basis of the correcting value and causes the user to check the setting information in the operation in the mode executed after the correcting value is inputted from the operating portion.

Further features of the present invention will become apparent from the following description of exemplary embodiments with reference to the attached drawings.

Figure 9:
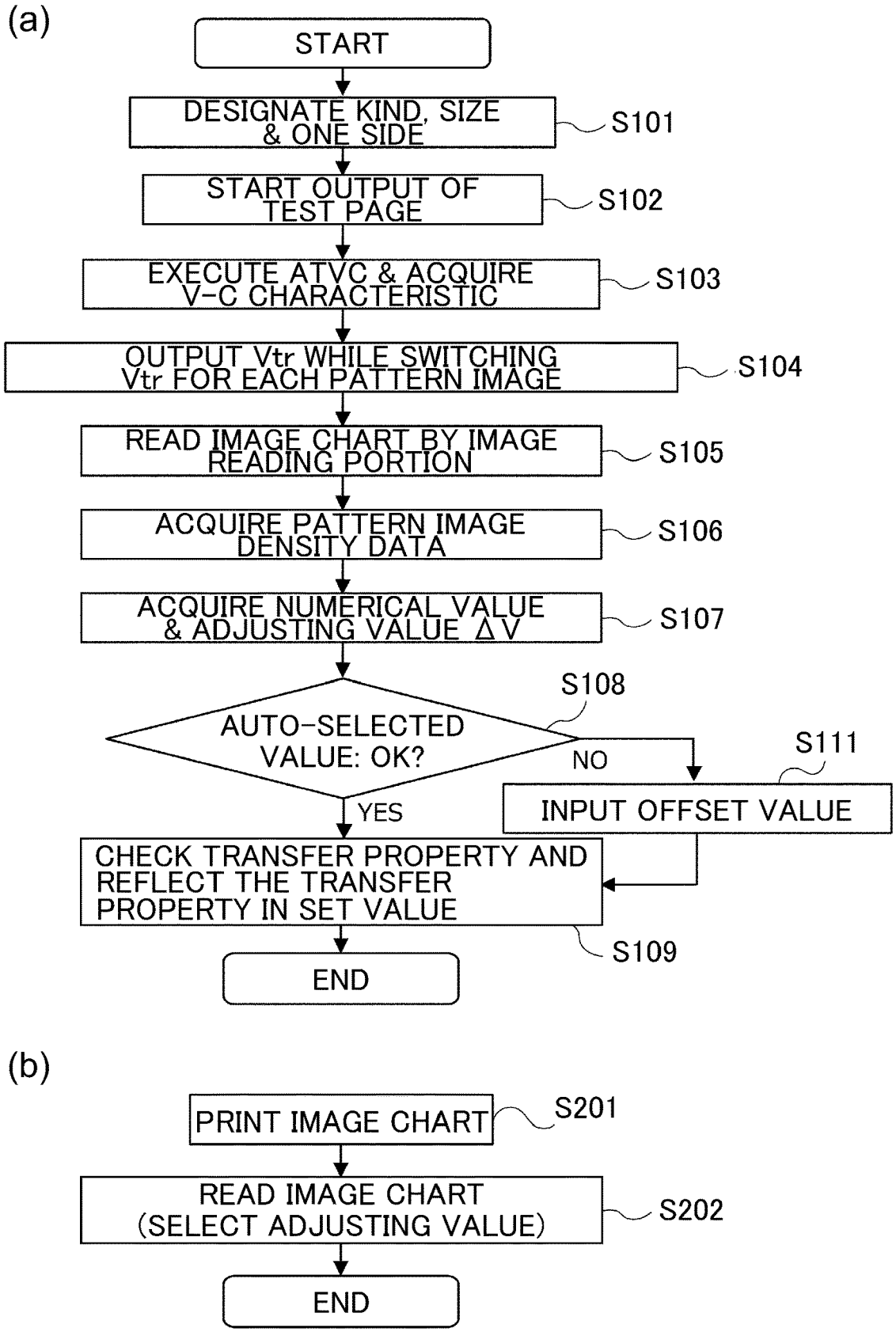

Part (a) of FIG. 9 is a flow-chart of the operation in the secondary transfer voltage adjusting mode according to the embodiment, and part (b) of FIG. 9 is a flowchart of the operation in the secondary transfer voltage adjusting mode after initial adjustment.

Figure 10:
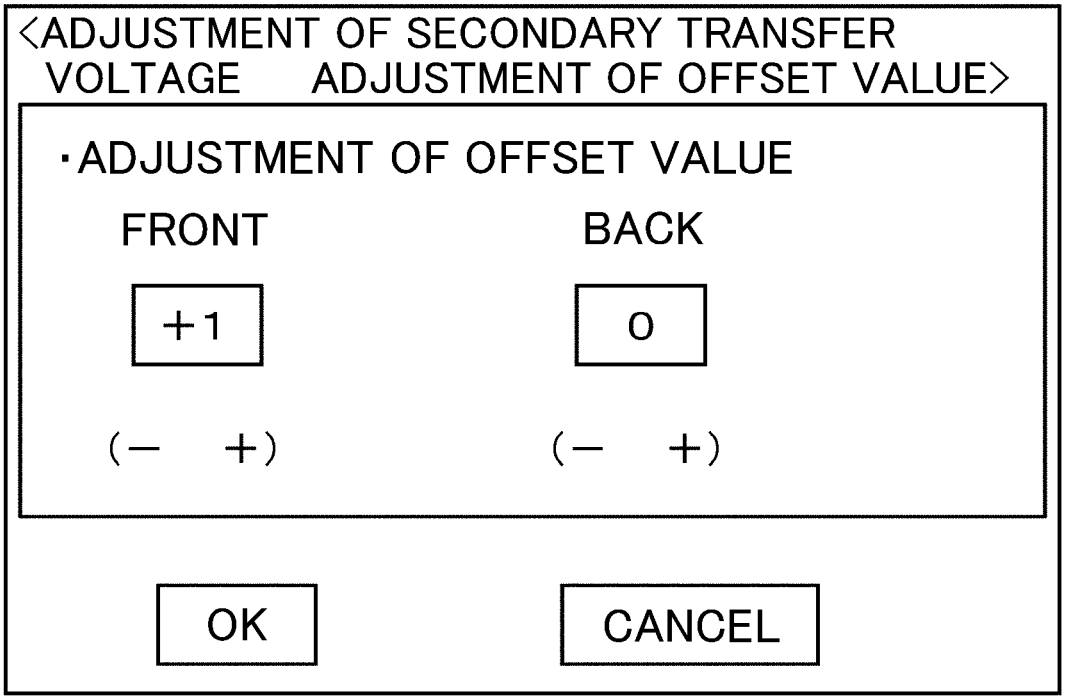

FIG. 10 is a schematic view showing an example of a setting screen of an offset value in the operation in the secondary transfer voltage adjusting mode according to the embodiment.

DESCRIPTION OF THE EMBODIMENTS

An embodiment will be described using FIGS. 1 to 10. First, an image forming apparatus according to this embodiment will be described using FIGS. 1 and 2.

[Image forming apparatus]

In this embodiment, as an example of an image forming apparatus 1, a full-color printer of a tandem type using an intermediary transfer system will be described. The image forming apparatus 1 includes an apparatus main assembly 10, an unshown recording material feeding portion, an image forming portion 40, an unshown recording material discharging portion, a controller 30, and an operating portion 70 (see FIG. 2).

Inside the apparatus main assembly 10, a temperature sensor 71 (see FIG. 2) capable of detecting a temperature in the image forming apparatus 1 and a humidity sensor 72 (see FIG. 2) capable of detecting a humidity in the image forming apparatus 1 are provided. The image forming apparatus 1 can form a four color-based full-color image on a recording material S depending on an image signal from an image reading portion 80, a host device such as a personal computer, or an external device such as a digital camera or a smartphone. Incidentally, the recording material S is one on which a toner image is formed, and as a specific example, it is possible to cite sheet materials such as plain paper, a synthetic resin sheet which is a substitute for the plain paper, thick paper, a sheet for an overhead projector, and the like.

The image forming portion 40 is capable of forming an image, on the basis of image information, on the recording material fed from the recording material feeding portion. The image forming portion 40 includes image forming units 50*y*, 50*m*, 50*c* and 50*k*, toner bottles 41*y*, 41*m*, 41*c* and 41*k*, exposure devices 42*y*, 42*m*, 42*c* and 42*k*, an intermediary transfer unit 44, a secondary transfer device 45, and a fixing portion 46.

The image forming apparatus 1 can perform full-color image formation, and the plurality of image forming units 50*y*, 50*m*, 50*c* and 50*k* have the constitution for four colors of yellow (y), magenta (w), cyan (c) and black (k), respectively, and are separately provided. For this reason, in FIG. 1, respective constituent elements for the four colors are shown by adding color identifiers to reference numerals thereof, but in the following, description will be made using the constituent elements of the image forming unit 50*y* as a representative in some cases. Incidentally, the image forming apparatus 1 is also capable of forming a single-color image of, for example, black or a multi-color image using the image forming unit 50 for a desired single color or the image forming units 50 for some of the four colors, respectively.

The image forming unit 50*y* includes a photosensitive drum 51*y* as an image bearing member movable while bearing the toner image, a charging roller 52*y* as a charging device, a developing device 20*y*, a pre-exposure device 54*y*, and a cleaning device provided with a cleaning blade 55*y*. The image forming unit 50*y* is integrally assembled into a unit as a cartridge, and is constituted so as to be mountable in and dismountable from the apparatus main assembly. The image forming unit 50*y* forms the toner image on an intermediary transfer belt 44*b* described later.

The photosensitive drum 51*y* is rotatable and bears an electrostatic image used for image formation. In this embodiment, the photosensitive drum 51*y* is formed in a cylindrical shape of 30 mm in outer diameter and is a negatively chargeable organic photosensitive member (OPC). Further, the photosensitive drum 51*y* is rotationally driven at a predetermined process speed (peripheral speed) in an arrow direction. The photosensitive drum 51*y* uses a cylinder made of aluminum as a base material and includes, as a surface layer at a surface thereof, three layers consisting of an undercoating layer, a photocharge-generating layer, and a charge-transporting layer which are successively laminated in a named order on the base material.

The charging roller 52*y* contacts the surface of the photosensitive drum 51*y* and uses a rubber roller rotatable by rotation of the photosensitive drum 51*y*, and electrically charges the surface of the photosensitive drum 51*y* uniformly. To the charging roller 52*y*, a charging bias voltage source 73 (see FIG. 2) is connected. The charging bias voltage source 73 applies a charging bias to the charging roller 52*y* and charges the photosensitive drum 51*y* via the charging roller 52*y*. The exposure device 42*y* is a laser scanner and forms the electrostatic image on the photosensitive drum 51*y* by emitting laser light in accordance with the image information of separated color outputted from the controller 30.

The developing device 20*y* develops the electrostatic image, formed on the photosensitive drum 51*y*, into a toner image with toner under application of a developing bias. The developing device 20*y* includes a developing sleeve 24*y* as a developer carrying member. The developing device 20*y* not only accommodates a developer supplied from the toner bottle 41*y* but also develops the electrostatic image formed on the photosensitive drum 51*y*.

The developing sleeve 24*y* is constituted by a non-magnetic material of, for example, aluminum or non-magnetic stainless steel, and in this embodiment, the developing sleeve 24*y* made of aluminum is used. Inside the developing sleeve 24*y*, a roller-shaped magnet roller is fixedly provided in a non-rotatable state relative to a developing container. The developing sleeve 24*y* carries the developer including non-magnetic toner and a magnetic carrier and feeds the developer to a developing region opposing the photosensitive drum 51*y*. To the developing sleeve 24*y*, a developing bias voltage source 74 (see FIG. 2) is connected. The developing bias voltage source 74 applies a developing bias to the developing sleeve 24*y*, and develops the electrostatic image formed on the photosensitive drum 51*y*.

The toner image formed on the photosensitive drum 51*y* through development is primary-transferred onto the intermediary transfer belt 44*b* of the intermediary transfer unit 44. The photosensitive drum 51*y* after the primary transfer is charge-removed at the surface thereof by the pre-exposure device 54*y*. The cleaning blade 55*y* is of a counter blade type and is contacted to the photosensitive drum 51*y* with a predetermined pressing force. After the primary transfer, the toner remaining on the photosensitive drum 51*y* without being transferred onto the intermediary transfer belt 44*b* is removed by the cleaning blade 55*y* provided in contact with the photosensitive drum 51*y* and prepares for a subsequent image forming step.

The intermediary transfer unit 44 includes a driving roller 44*a*, a follower roller 44*d*, an inner secondary transfer roller 45*a*, the intermediary transfer belt 44*b* stretched by these rollers (stretching rollers), and primary transfer rollers 47*y*, 47*m*, 47*c* and 47*k*, and the like. The intermediary transfer belt 44*b* as an image bearing member and an intermediary transfer member form primary transfer portions 48*y*, 48*m*, 48*c* and 48*k* between itself and the photosensitive drums 51*y*, 51*m*, 51*c* and 51*k*, respectively, and is circulated and moved (i.e., rotated) while carrying the toner images. The follower roller 44*d* is a tension roller for controlling tension of the intermediary transfer belt 44*b* at a certain level. To the follower roller 44*d*, a force such that the intermediary transfer belt 44*b* is pressed toward the surface of the intermediary transfer belt 44*b* is applied by an urging force of an unshown urging spring, so that tension of about 2-5 kgf is applied to the intermediary transfer belt 44*b* in a (recording material) feeding direction of the intermediary transfer belt 44*b* by this force.

The primary transfer rollers 47*y*, 47*c*, 47*c* and 47*k* are disposed opposed to the photosensitive drums 51*y*, 51*m*, 51*c* and 51*k*, respectively, via the intermediary transfer belt 44*b*. The primary transfer roller 47*y* is disposed so as to sandwich the intermediary transfer belt 44*b* between itself and the photosensitive drum 51*y*, and primary-transfers the toner image, formed on the surface of the photosensitive drum 51*y*, onto the intermediary transfer belt 44*b* at the primary transfer portion 48*y* by applying a primary transfer voltage thereto. To the primary transfer roller 47*k*, a primary transfer voltage source 75*y* is connected. To the primary transfer voltage source 75*y*, a voltage detecting sensor 75*ay* for detecting an output voltage and a current detecting sensor 75*by* for detecting an output current are connected (see FIG. 2).

Incidentally, the primary transfer voltage sources 75*y*, 75*m*, 75*c* and 75*k* are provided for the primary transfer rollers 47*y*, 47*m*, 47*c* and 47*k*, respectively, and primary transfer voltages applied to the primary transfer rollers 47*y*, 47*m*, 47*c* and 47*k* are independently controllable.

The primary transfer roller 47*y* is, for example, 15-20 mm in outer diameter, and includes an elastic layer of an ion-conductive foam rubber (NBR rubber) and a core metal. As the primary transfer roller 47*y*, a roller of $1\times10^5$-$1\times10^8\Omega$ in resistance (measured under N/N (23° C., 50% RH) condition, under application of 2 kV) is used. Incidentally, this is also true for other primary transfer rollers 47*m*, 47*c* and 47*k*.

The intermediary transfer belt 44*b* is rotatable and is rotated in an arrow direction at a predetermined speed. The intermediary transfer belt 44*b* contacts the photosensitive drums 51*y*, 51*m*, 51*c* and 51*k* and forms the primary transfer portions 47*y*, 48*m*, 48*c* and 48*k* between itself and the photosensitive drums 51*y*, 51*m*, 51*c* and 51*k*, respectively. The primary transfer voltage is applied from the primary transfer voltage sources 75*y*, 75*m*, 75*c* and 75*k* (see FIG. 2) to the primary transfer portions 48*y*, 48*m*, 48*c* and 48*k*, respectively, whereby the toner images formed on the photosensitive drums 51*y*, 51*m*, 51*c* and 51*k* are primary-transferred at the primary transfer portions 48. To the intermediary transfer belt 44*y*, the primary transfer voltage of the positive polarity is applied by the primary transfer rollers 47*y*, 47*m* 47*c* and 47*k*, whereby the toner images of the negative polarity are successively multiple-transferred from the photosensitive drums 51*y*, 51*m*, 51*c* and 51*k* onto the intermediary transfer belt 44*b*.

The intermediary transfer belt 44*b* is an endless belt including a three-layer structure consisting of a base layer, an elastic layer, and a surface layer from a back surface side. As a resin material constituting the base layer, a material in which carbon black is contained as an anti-static agent, in an appropriate amount, in a resin such as polyimide or polycarbonate or in various rubbers is used, and a thickness of the base layer is 0.05-0.15 mm. As an elastic material constituting the elastic layer, a material in which an ion-conductive agent is contained, in an appropriate amount, in various rubbers, such as urethane rubber and silicone rubber is used, and a thickness of the elastic layer is 0.1-0.500 mm.

A material constituting the surface layer is a resin material such as fluorine-containing resin, and a depositing force of the toner onto the surface of the intermediary transfer belt 44*b* is made small, so that the toner is easily transferred onto the recording material S at a secondary transfer portion N. The thickness of the surface layer is 0.0002-0.020 mm. In this embodiment, as regards the surface layer, one kind of resin materials of polyurethane, polyester, epoxy resin, and the like, or two or more kinds of materials of elastic materials such as an elastic rubber, elastomer, butyl rubber, and the like is used as a base material.

Further, in this base material, as a material for enhancing a lubricating property by making surface energy small, one kind or two or more kinds of powder or particles of the fluorine-containing resin are dispersed or such powder or particles are dispersed with different particle sizes, so that the surface layer is formed.

The intermediary transfer belt 44*b* in this embodiment is $5\times10^8$-$1\times10^{14}$ Ω.cm (23° C., 50% RH) in volume resistivity and is 60-85° (23° C., 50% RH) in MD1 hardness. Further, a coefficient of static friction is 0.15-0.6 (23° C., 50% RH) measured by type 94i manufactured by HZIDON (Shinto Scientific Co., Ltd.). In this embodiment, the intermediary transfer belt 44*b* has the three-layer structure, but may also have a single-layer constitution of the material corresponding to the above-described base layer.

The secondary transfer device 45 includes the inner secondary transfer roller 45*a* as an inner roller and an outer secondary transfer roller 45*b* as an outer roller and a transfer member. The inner secondary transfer roller 45*a* stretches the intermediary transfer belt 44*b* in contact with an inner surface of the intermediary transfer belt 44*b*, and is disposed opposed to the outer secondary transfer roller 45*a* via the intermediary transfer belt 44*b*. To the outer secondary transfer roller 45*b*, a secondary transfer voltage source 76 is connected. To the secondary transfer voltage source 76, a voltage detecting sensor 76*a* for detecting an output voltage and a current detecting sensor 76*b* as a current detecting portion for detecting an output current are connected (see FIG. 2).

The secondary transfer voltage source 76 applies a DC voltage, as a secondary transfer voltage, to the outer secondary transfer roller 45*b*. The outer secondary transfer roller 45*b* contacts the intermediary transfer belt 44*b* and forms the secondary transfer portion N between itself and the intermediary transfer belt 44*b*. By applying the secondary transfer voltage of a polarity opposite to the charge polarity of the toner, the outer secondary transfer roller 45*b* collectively secondary-transfers the toner images, primary-transferred and carried on the intermediary transfer belt 44*b*, onto the recording material S supplied to the secondary transfer portion N.

Incidentally, the secondary transfer voltage source 76 may also be connected to the inner secondary transfer roller 45*a*. That is, the secondary transfer voltage source 76 applies, to the inner secondary transfer roller 45*a* or the outer secondary transfer roller 45*b*, the secondary transfer voltage for transferring the toner images from the intermediary transfer belt 44*b* onto the recording material S.

In this embodiment, a core metal of the inner secondary transfer roller 45*a* is connected to a ground potential. When the recording material S is supplied to the secondary transfer device 45, in this embodiment, the secondary transfer voltage which is subjected to constant-voltage control in which the polarity is opposite to the charge polarity of the toner is applied to the outer secondary transfer roller 45*b*. For example, the secondary transfer voltage of 1-7 kV is applied and a current of 40-120 μA is caused to flow through the outer secondary transfer roller 45*b*, so that the toner images on the intermediary transfer belt 44*b* are secondary-transferred onto the recording material S.

The outer secondary transfer roller 45*b* is, for example, 20-25 mm in outer diameter, and includes an elastic layer of an ion-conductive foam rubber (NBR rubber) and a core metal. As the outer secondary transfer roller 45*b*, a roller of $1\times10^5$-$1\times10^8\Omega$ in resistance (measured under N/N (23° C./50% RH) condition, under application of 2 kV) is used.

Further, the intermediary transfer unit 44 includes a belt cleaning device 60. The belt cleaning device 60 removes deposited matter such as the toner remaining on the intermediary transfer belt 44*b* after a secondary transfer step. In an example shown in FIG. 1, as the belt cleaning device 60, a constitution including two cleaning portions 61 and 62, to which voltages of polarities different from each other, is shown. Each of the cleaning portions 61 and 62 is provided with a rotatable fur brush in contact with the intermediary transfer belt 44*b* and a collecting roller for collecting the toner deposited on the fur brush. By applying the voltages different in polarity from each other to the cleaning portions 61 and 62, the residual toner on the intermediary transfer belt 44*b* is removed. Incidentally, the belt cleaning device 60 may also be a belt cleaning device provided with a cleaning blade for removing the residual toner or the like in contact with the intermediary transfer belt 44*b*.

The fixing portion 46 includes a fixing roller 46*a* and a pressing roller 46*b*. Between the fixing roller 46*a* and the pressing roller 46*b*, the recording material S is nipped and fed, whereby the toner image transferred on the recording material S is heated and pressed and thus is fixed on the recording material S. Incidentally, a temperature of the fixing roller 46*a* is detected by a fixing temperature sensor 77 (see FIG. 2). The recording material discharging portion discharges the recording material S, fed through a discharging passage, for example, through a discharge opening and then stacks the recording material S on a discharge tray. Further, between the fixing portion 46 and the discharge opening, an unshown reveres feeding passage, in which the recording material S after the fixing is turned upside down and is capable of being passed through the secondary transfer device 45 again, is provided. By an operation of the reverse feeding passage, formation of images on both sides of a single recording material can be realized.

At an upper portion of the apparatus main assembly 10, an automatic original feeding device 81 for automatically feeding the recording material (original) on which an image is formed toward an image reading portion 80, and the image reading portion 80 for reading the image of the recording material fed by the automatic original feeding device 81 are provided. This image reading portion 80 is constituted so that the original disposed on a platen glass 82 is illuminated with an unshown light source and that density data of the image on the original can be acquired by an unshown image reading element.

Figure 1:
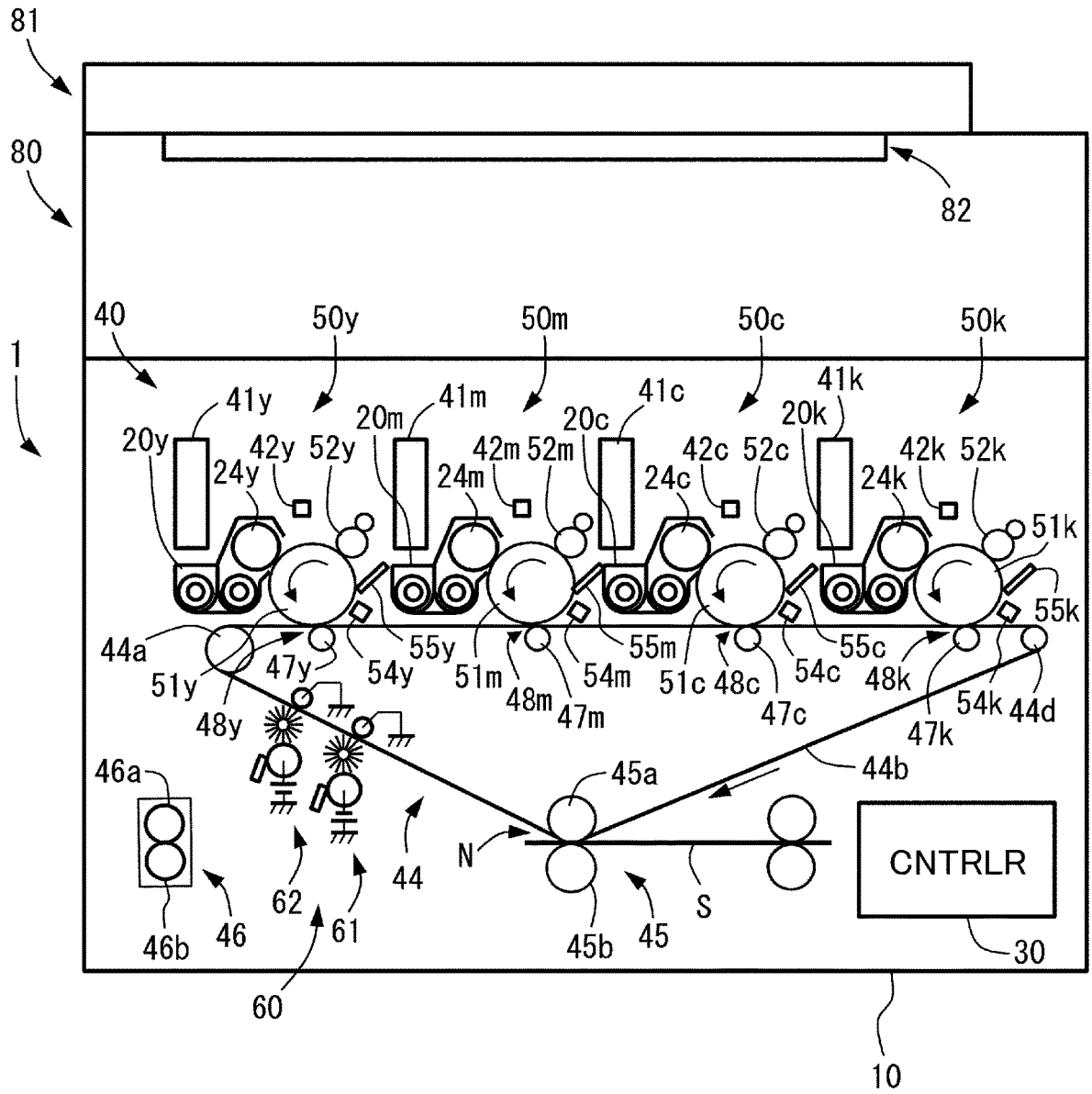
FIG. 1 is a schematic structural sectional view of an image forming apparatus according to an embodiment.
Figure 2:
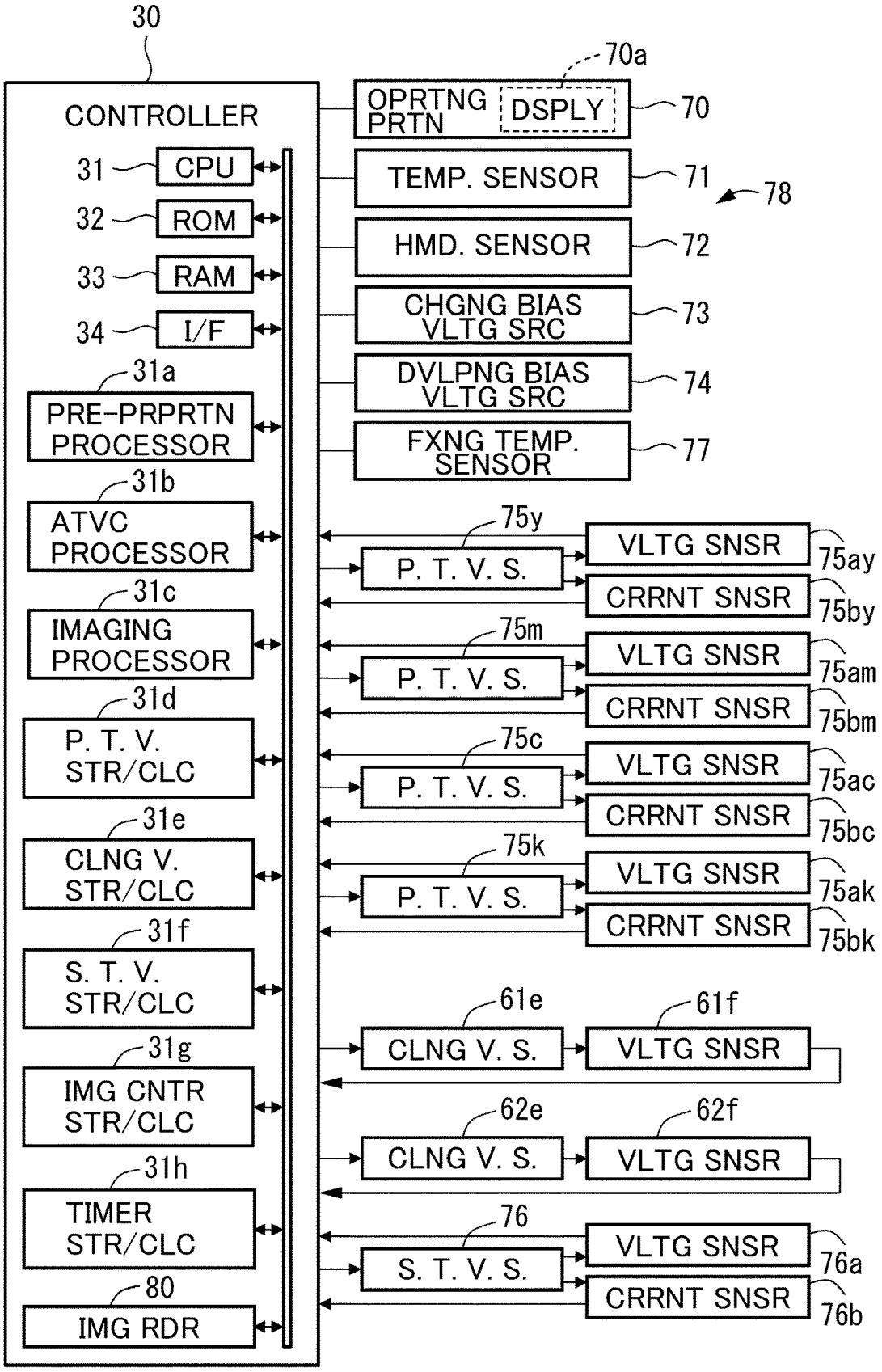
FIG. 2 is a control block diagram of the image forming apparatus according to the embodiment.

As shown in FIG. 2, the controller 30 as a control means is constituted by a computer and is capable of controlling respective constituent elements of the image forming apparatus 1. The controller 30 includes, for example, a CPU 31, a ROM 32 for storing programs for controlling respective portions, a RAM 33 for temporarily storing data, and an input/output circuit (I/F) 34 for inputting/outputting signals from/to an external portion. The CPU 31 is a microprocessor for managing entirety of control of the image forming apparatus 1 and is a main body of a system controller. The CPU 31 is connected to the recording material feeding portion, the image forming portion 40, the recording material discharging portion, and the operating portion 70 via the input/output circuit 34, and not only transfers signals between itself and respective portions but also controls operations of the respective portions.

In the ROM 32, an image formation control sequence for forming an image on the recording material S, and the like are stored.

To the controller 30, the charging bias voltage source 73, the developing bias voltage source 74, the primary transfer voltage sources 75*y*, 75*m*, 75*c* and 75*k*, and the secondary transfer voltage source 76 are connected and are controlled by signals from the controller 30, respectively. Further, to the controller 30, the temperature sensor 71, the humidity sensor 72, the voltage detecting sensor 76*a* and the current detecting sensor 76*b* for the secondary transfer voltage source 76, and the fixing temperature sensor 77 are connected. Further, to the controller 30, the voltage detecting sensors 75*ay*, 75*am*, 75*ac* and 75*ak* and the current detecting sensors 75*by*, 75*bm*, 75*bc* and 75*bk* for the primary transfer voltage sources 75*y*, 75*m*, 75*c* and 75*k* are connected. Signals detected by the respective sensors are inputted to the controller 30. Incidentally, by the temperature sensor 71 and the humidity sensor 72, an environment detecting portion 78 capable of detecting values relating to temperature and humidity is formed.

The operating portion 70 as an inputting portion and a changing portion includes a display portion 70*a* consisting of operating buttons, a liquid crystal panel, and the like. A user is capable of executing an image forming job by operating the operating portion 70, and the controller 30 receives a signal from the operating portion 70 and causes the various devices of the image forming apparatus 1 to operate. The image forming job refers to a series of operations, executed on the basis of an instruction from the operating portion 70 or the external device connected to the image forming apparatus 1, for forming the image on the recording material.

In this embodiment, the controller 30 includes an image formation pre-preparation process portion 31*a*, an ATVC process portion 31*b*, and an image forming process 31*c*. Further, the controller 30 includes a primary transfer voltage storing portion/calculating (computing) portion 31*d*, a cleaning voltage storing portion/calculating portion 31*e*, a secondary transfer voltage storing portion/calculating portion 31*f*, an image forming counter storing portion/calculating portion 31*g*, and a timer storing portion/calculating portion 31*h*. Incidentally, the respective process portions and the storing portions/calculating portions may also be provided as parts of the CPU 31 or the RAM 33. The controller 30 is capable of executing operations in a plural-color mode and a single-color mode in a switching manner. In the operation in the plural-color mode, an image is formed with a plurality of colors by applying the primary transfer voltage to the plurality of primary transfer portions 48*y*, 48*m*, 48*c* and 48*k*. In the operation in the single-color mode, an image is formed with a single color by applying the primary transfer voltage to only one primary transfer portion (for example, 48*k*) of the plurality of primary transfer portions 48*y*, 48*m*, 48*c* and 48*k*.

Next, an image forming operation in the thus-constituted image forming apparatus 1 will be described.

When the image forming portion is started, first, the photosensitive drum 51 is rotated and the surface thereof is electrically charged by the charging roller 52*y*. Then, by the exposure device 42*y*, laser light is emitted to the photosensitive drum 51*y* on the basis of image information, so that an electrostatic latent image is formed on the surface of the photosensitive drum 51*y*.

By the developing device 20*y*, this electrostatic latent image is developed with the toner and thus is visualized as a toner image.

Then, the toner image on the photosensitive drum 51*y* is primary-transferred onto the intermediary transfer belt 44*b*. Such an operation is also performed at the image forming portions for other colors, so that toner images of a plurality of colors are primary-transferred superposedly onto the intermediary transfer belt 44*b*.

On the other hand, the recording material S is supplied in parallel to such a toner image forming operation, so that the recording material S is conveyed to the secondary transfer device 45 by being timed to the toner images on the intermediary transfer belt 44*b*.

Then, in the secondary transfer portion N, the toner images are transferred from the intermediary transfer belt 44*b* onto the recording material S. The recording material S on which the toner images are transferred is conveyed to the fixing portion 46, where unfixed toner images are heated and pressed and thus are fixed on the surface of the recording material S, and then is discharged from the apparatus main assembly 10.

[ATVC]

At present, in order to enhance added value of a product, various kinds of recording materials are used, and a difference between these recording materials is roughly divided into a difference is surface smoothness such as high-quality paper and coated paper and a difference in paper resistance value due to paper thickness and a filler. In order to transfer the toner image onto the recording material, an optimum value of the secondary transfer voltage applied to the transfer member changes depending on the differences in smoothness and resistance value of the recording material, and therefore, in order to obtain a good transfer image, it is required that an optimum voltage value is selected depending on the recording material used. Further, the resistance value of the recording material largely changes by inclusion of ambient water content, and therefore, even in the case where the same recording material is used, it is required that a value to which an operation environment (temperature, humidity) is added is selected. When the voltage outputted at the transfer portion is not appropriate for the recording material, image defects at the transfer portion, such as poor image density and white dropout are liable to occur. In order to apply an optimum secondary transfer voltage depending on such a kind and the operation environment of the recording material, in this embodiment, during the image formation, the secondary transfer voltage applied to the secondary transfer portion N is set by ATVC (Active Transfer Voltage Control). The ATVC as an operation in a transfer voltage setting mode is an operation in a mode in which a plurality of different first transfer voltages (second test voltages) are applied to the outer secondary transfer roller 45*b* when the recording material is absent in the secondary transfer portion and currents are detected at the respective transfer voltages by the current detecting sensor 76*b*, and thus a relationship between the transfer voltage and the current is acquired. That is, in the ATVC (operation), in a state in which the recording material S does not pass through the secondary transfer portion N, constant voltages at a plurality of levels are applied to the outer secondary transfer roller 45*b*, and then values of currents flowing through the outer secondary transfer roller 45*b* at that time are measured. Then, a voltage-current characteristic is acquired, and on the basis of this, a voltage corresponding to a target current value necessary for transfer of the toner image during the image formation is calculated by interpolation. Further, a voltage value obtained by adding part voltage of the recording material to the resultant voltage is set at a transfer voltage value used during the image formation. The target transfer current value and the part voltage of the recording material are set in accordance with table data set in advance depending on a temperature and a humidity in an environment in which the image forming apparatus is placed.

Figure 3:
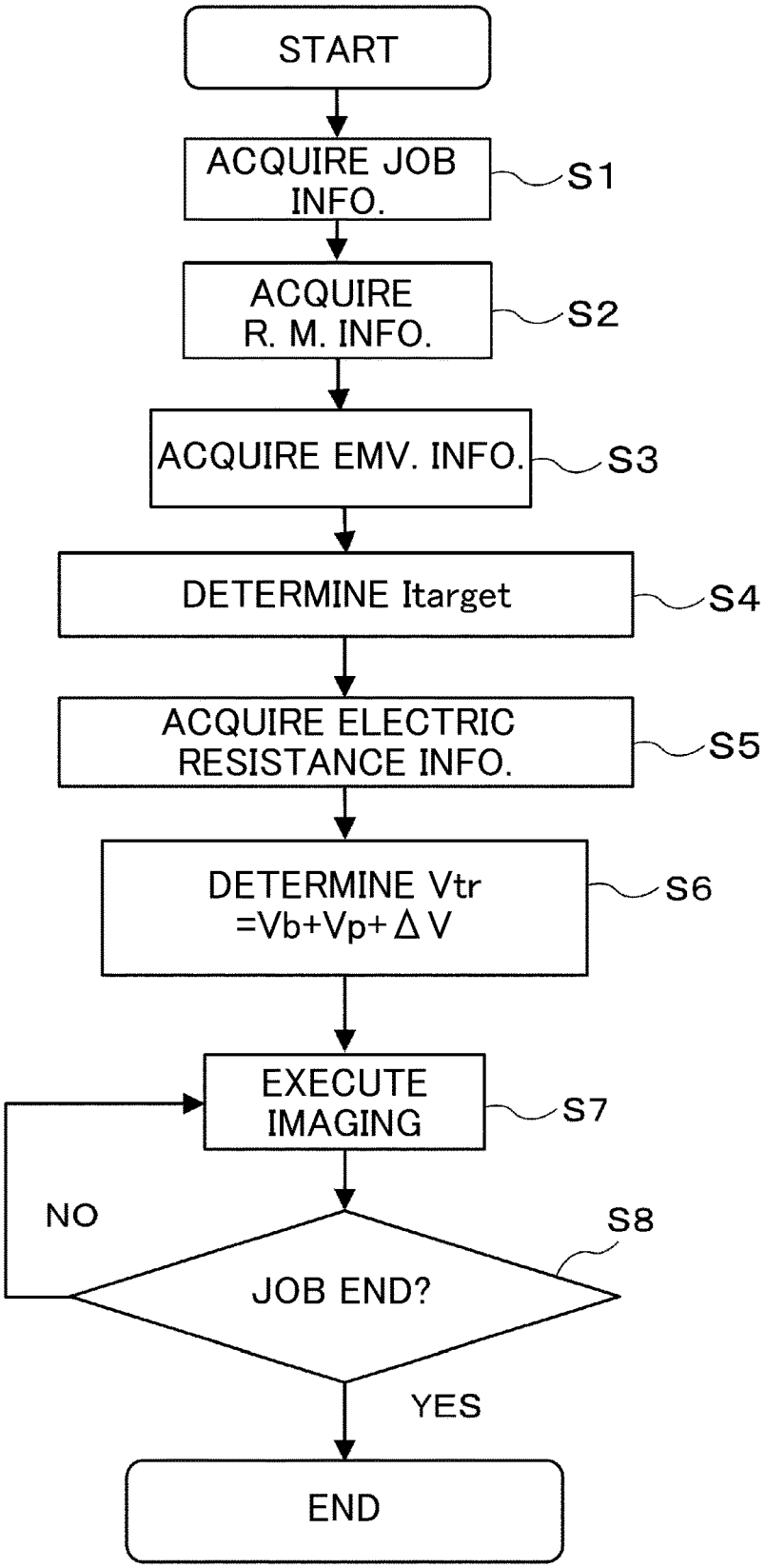
FIG. 3 is a flowchart of ATVC according to the embodiment.

A flow of such ATVC will be specifically described using FIG. 3. When the controller 30 acquires job information from the operating portion 70 or an unshown external device, a job operation is started (S1). The controller 30 writes the job information, such as image information or recording material information, in the RAM 33 (S2). Then, the controller 30 acquires environmental information (value detected by the environment detecting portion 78) detected by the temperature sensor 71 and the humidity sensor 72 (S3). Further, in the ROM 32 as a storing portion, information indicating a correlation between the environmental information and a target transfer current Itarget for transferring the toner images from the intermediary transfer belt 44*b* onto the recording material S is stored.

The controller 30 acquires the target transfer current Itarget corresponding to the environment from data indicating the relationship between the above-described environmental information and the target transfer current Itarget on the basis of the environmental information read in S3, and writes this (target transfer current Itarget) in the RAM 33 (S4). Incidentally, the reason why the target transfer current Itarget is changed is that a toner charge amount changes depending on the environment.

Then, the controller 30 acquires information on an electric resistance of the secondary transfer portion N by the ATVC before the toner images on the intermediary transfer belt 44*b* and the recording material S onto which the toner images are to be transferred reach the secondary transfer portion N (S5). That is, in a state in which the outer secondary transfer roller 45*b* and the intermediary transfer belt 44*b* are contacted to each other, predetermined voltages of a plurality of levels are supplied from the secondary transfer voltage source 76 to the outer secondary transfer roller 45*b*. Then, current values when the predetermined voltages are supplied are detected by the current detecting sensor 76*b*, so that a relationship between the voltage and the current (i.e., voltage-current characteristic) is acquired. This voltage-current characteristic changes depending on the electric resistance of the secondary transfer portion N.

Next, the controller 30 acquires a value of a voltage to be applied from the secondary transfer voltage source 76 to the outer secondary transfer roller 45*b* (S6). That is, on the basis of the target transfer current Itarget written in the RAM 33 in S4 and the relationship between the voltage and the current acquired in S5, the controller 30 acquires a voltage value Vb necessary to cause the target transfer current Itarget to flow through the secondary transfer portion N in a state in which the recording material S is absent in the secondary transfer portion N.

Further, in the ROM 32, information for acquiring a recording material part voltage Vp is stored. The recording material part voltage Vp is held as table data showing a relationship between a kind of the recording material (for example, a paper kind such as plain paper, thick paper, thin paper), an ambient water content and the recording material part voltage Vp for each of sections of a basis weight of the recording material S. The table data for acquiring the recording material part voltage Vp is acquired by selecting a recording material of a representative grade for each of the sections of the basis weight and then by subjecting the recording material to an experiment in advance. Incidentally, the controller 30 is capable of acquiring the ambient water content on the basis of the environmental information (information on the temperature and the humidity) detected by the temperature sensor 71 and the humidity sensor 72. The controller 30 acquires the recording material part voltage Vp from the above-described table data on the basis of the job information acquired in S1 and the environmental information acquired in S3.

Further, in the case where an adjusting value is set by an operation in an adjusting mode of the secondary transfer voltage described later, an adjusting amount ΔV thereof is acquired. Then, the controller 30 acquires, as a secondary transfer voltage Vtr, a voltage applied from the secondary transfer voltage source 76 to the outer secondary transfer roller 45*b* when the recording material S passes through the secondary transfer portion N, which is Vb+Vp+ΔV obtained by the sum of Vb, Vp and ΔV, and is written in the RAM 33.

[Adjusting Mode of Secondary Transfer Voltage]

[Adjusting mode of secondary transfer voltage]

As described above, by using the ATVC, the transfer voltage based on the kind of the recording materials is very large, and even when the recording materials have the same basis weight section and the same paper kind, the recording materials are different in resistance depending on paper brand in some instances. Thus, in the case where the recording materials with various resistance values are used, setting of the optimum transfer voltage was frequently made using an operation in a mode, in which an adjusting value of an image forming condition can be changed, such as a service mode or a user mode. That is, in many cases, the appropriate secondary transfer voltage is sought while changing an output value of the secondary transfer voltage in the operation in this mode and while the user actually outputs the image. However, adjustment by the operation in the service mode or the user mode is an operation performed by stopping an output operation of the apparatus main assembly, and separately from an original recording material for output, an adjusting recording material is needed, so that a load is imposed on the user. Therefore, in this embodiment, a constitution including an operation in an adjusting mode of the secondary transfer voltage is employed.

The operation in the adjusting mode of the secondary transfer voltage, which is a first mode, and a second mode will be described. For example, depending on the kind of the recording material used by the user, the resistance value of the recording material is different from the representative recording material resistance value held as the above-described table data, and therefore, in the case where the recording material part voltage Vp in the table data is used, optimum transfer cannot be carried out in some instances.

Specifically, in order to prevent an occurrence of defective image when the toner images on the intermediary transfer belt 44*b* are transferred onto the recording material, it is required that the optimum secondary transfer voltage Vtr is applied. In the case where the resistance value of the recording material used by the user is higher than the recording material resistance value held as the table data, there is a possibility that a current necessary for transferring the toner image becomes insufficient and thus a defective transfer image (transfer void image) occurs. For that reason, in this case, the secondary transfer voltage Vtr has to be set at a high value.

Further, in the case where the water content of the recording material decreases and an electric discharge phenomenon is liable to occur, there is a possibility that an image defect such as a void image due to abnormal discharge occurs, and in this case, the secondary transfer voltage Vtr has to be set at a low value.

Therefore, an operation in a mode which is performed for obtaining the above-described optimum adjusting amount ΔV for individual recording materials in order to provide the appropriate secondary transfer voltage Vtr at which the defective image does not occur is the operation in the adjusting mode. In the operation in the adjusting mode, an operation in a semi-automatic adjusting mode as a selection mode including the test chart output mode is executable.

[Test Chart Output Mode]

In the operation in the test chart output mode, predetermined test images are transferred from the intermediary transfer belt 44*b* onto the recording material at a plurality of different transfer voltages (test voltages, first test voltages), and then the recording material is outputted. That is, the operation in the test chart output mode in the adjusting mode is an operation in a mode in which a test chart for adjusting the transfer voltage, set for during the image formation, by transferring the predetermined test images from the intermediary transfer belt 44*b* onto the recording material under application of the plurality of different test voltages to the outer secondary transfer roller 45*b* is outputted.

Figure 4:
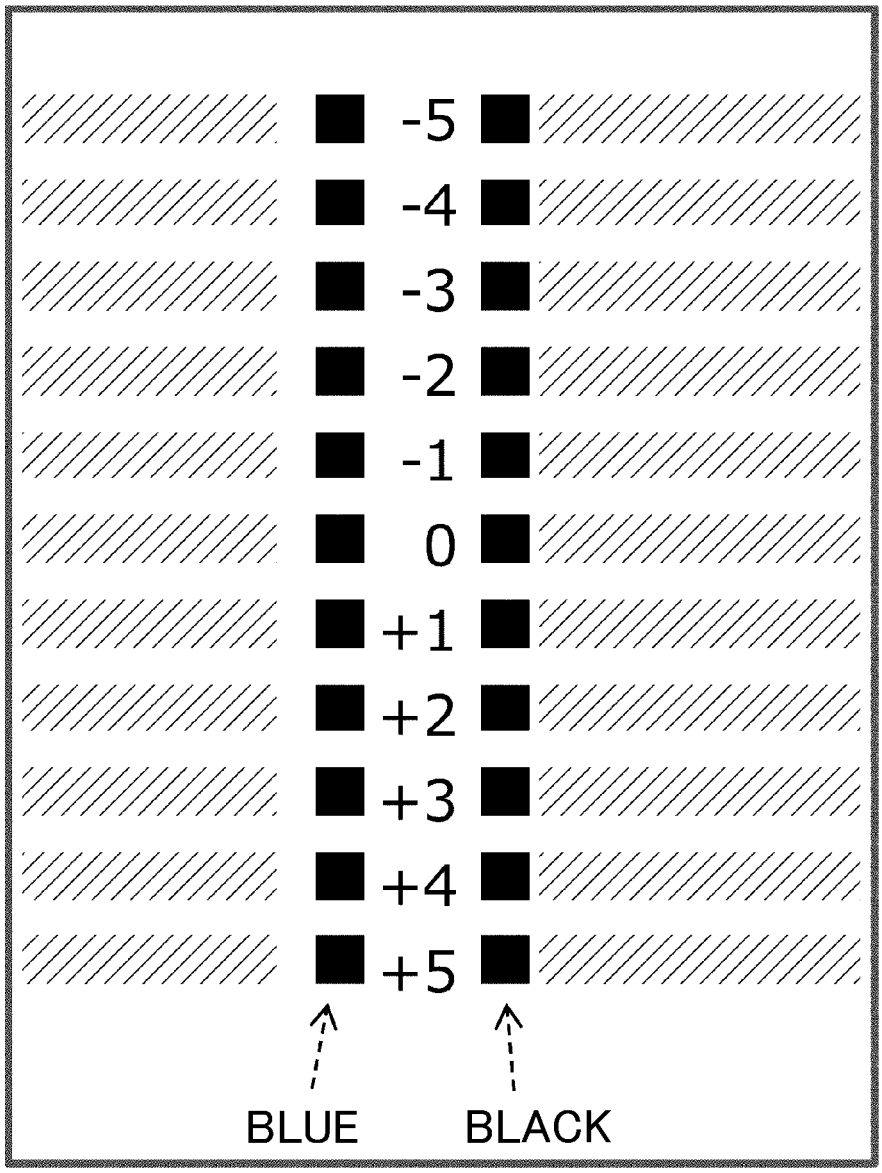
FIG. 4 is a schematic view showing an example of an adjusting image chart in an operation in a secondary transfer voltage adjusting mode according to the embodiment.
Figure 5:
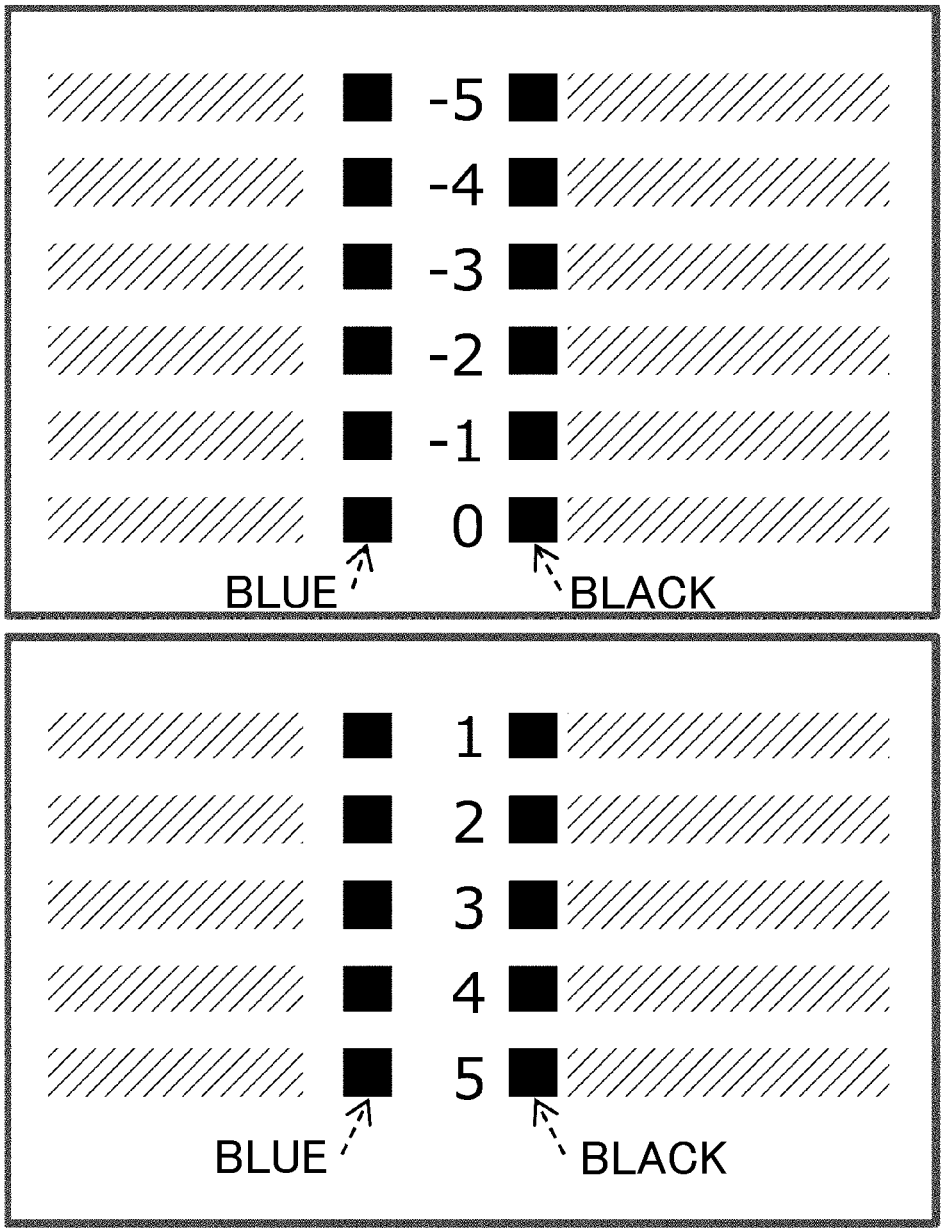
FIG. 5 is a schematic view showing another example of the adjusting image chart in the operation in the secondary transfer voltage adjusting mode according to the embodiment.

Specifically, a recording material on which an adjusting image chart as shown in FIGS. 4 and 5 is formed is outputted. As regards the adjusting image chart shown in FIGS. 4 and 5, pattern images each including a solid density image (solid black portion) and a halftone density portion (hatched portion) are formed. Further, the respective pattern images are formed while changing a transfer property by switching an output value of the secondary transfer voltage Vtr for each of the pattern images.

Then, on the basis of the plurality of predetermined test images on the outputted recording material, the transfer voltage during the image formation is adjusted by using the transfer voltage selected from the plurality of different transfer voltages. For example, the user selects the transfer voltage corresponding to the image discriminated by eye observation as an optimum image from the plurality of predetermined test images on the outputted recording material, and then the user adjusts the secondary transfer voltage Vtr used during subsequent image formation by using the selected transfer voltage. That is, the user selects the pattern image, providing an optimum transfer property from the adjusting image chart, and the controller 30 acquires an adjusting amount ΔV of the secondary transfer voltage Vtr.

On the other hand, the operation in the semi-automatic adjusting mode (selection mode) in which an appropriate pattern image is selected using the first reading portion 80 as a density detecting portion is capable of being executed. In the operation in the semi-automatic adjusting mode, a plurality of images (predetermined test images) corresponding to the plurality of test voltages on the adjusting image chart outputted in the operation in the test chart output mode is detected by the image reading portion 80. Then, on the basis of a detection result, an adjusting value for a transfer voltage set in advance by a predetermined selection standard is automatically selected. That is, in the image forming apparatus operable in the semi-automatic adjusting mode using the first reading portion 80, the outputted adjusting image chart is read by the image reading portion 80 and the adjusting value ΔV providing the optimum transfer setting is automatically selected from the acquired density data. Detailed explanation of the operation in the semi-automatic adjusting mode will be described later.

The adjusting image chart will be specifically described using FIGS. 4 and 5. In the operation in the adjusting mode of the secondary transfer voltage in this embodiment, an image chart including pattern images, in each of which a solid density image of a secondary color of blue, a solid density image of black (single color), and a halftone density image of black, which are as shown in FIG. 4 and which are suitable for discriminating the transfer property, are arranged, is used. Incidentally, when a size thereof is small, it is difficult to make discrimination, and therefore, an image size may preferable be 10 mm square or more, more preferably be 25 mm square or more. square or more, more preferably be 25 mm square or more.

On a side of each of the pattern images, a value corresponding to an adjusting amount ΔV of the secondary transfer voltages Vtr applied to the pattern image is indicated. That is, on the recording material outputted in the operation in the adjusting mode, values relating to a plurality of different transfer voltages are also printed correspondingly to a plurality of predetermined test images. To the pattern image with this value of 0, of Vb+Vp+ΔV of the secondary transfer voltage Vtr, a value of a voltage of which adjusting amount ΔV is 0 V set in the above-described ATVC is applied. Further, this adjusting amount ΔV is calculated in this embodiment in a manner such that 100 V is regarded as "1", and for example, in the case where the adjusting amount ΔV is 300 V, the adjusting amount ΔV is indicated as "+3", and to the pattern image, the secondary transfer voltage Vtr which is Vb+Vp+300 V is applied. That is, the plurality of first test voltages in the operation in the test chart output mode are set as those on sides where the voltage is increased and decreased from the transfer voltage, as a center value, set by the ATVC.

A maximum recording material size usable in the image forming apparatus is 13 inch×19.2 inch, but even in the case where the adjusting image chart is formed on a recording material smaller than the recording material with a maximum size, the adjusting image chart is outputted in conformity to the recording material on a leading end center basis. For example, as regards an A3 size, the adjusting image chart is outputted by cutting a region in a size of 292 mm×415 mm. In this embodiment, as an example, the adjusting image chart in which 11 pattern images are arranged was used, but the present invention is not limited thereto.

A size of each pattern image is such that each of the solid density images of the secondary color of blue and the (single color of) black is 25.7 mm square and that the halftone density image of gray extends from a portion adjacent to the associated solid density image (of blue or black) to an associated end portion with respect to a widthwise direction perpendicular to a feeding direction with a length of 25.7 mm with respect to the feeding direction. An interval of adjacent pattern images, with respect to the feeding direction is 9.5 mm, and the secondary transfer voltage Vtr is switched in this interval. The 11 pattern images arranged in the feeding direction range 387 mm so as to fall within the A3 size of 415 mm with respect to the feeding direction.

At leading and trailing end portions, there is a possibility that another defective image which is liable to occur only at the leading and trailing end portions occurs, and therefore, formation of the pattern images is not carried out.

In the case where the recording material shorter in length with respect to the feeding direction than the A3-size recording material is used, an adjusting image chart as shown in FIG. 5 is used. An entire size of this adjusting image chart is 13 inch×210 mm, so that this adjusting image chart is capable of meeting from the recording materials fed in an A5 short edge feeding manner to the recording materials of less than A3 size in length. In conformity to a length of the recording material with respect to the widthwise direction, a width of the halftone density image becomes short, and an output length of 5 pattern images with respect to the feeding direction is 167 mm, so that a trailing end margin becomes long correspondingly to the length of the recording material. On one sheet, only the 5 pattern images can be printed, so that in order to increase the number of pattern images, the pattern images are outputted on two sheets.

Comparison Example

An operation in a secondary transfer voltage adjusting mode including a semi-automatic adjusting mode in a comparison example will be described using a flowchart of FIG. 6. On a screen of the secondary transfer voltage adjusting mode, the user selects a kind and a size of the recording material for which the secondary transfer voltage is intended to be adjusted and whether printing is one-side printing or double-side printing through the operating portion 70 (S101). Here, the case where for an A3-size recording material with a basis weight of 150 g/m$^2$ and of which setting section in the image forming apparatus is thick paper (121-152 g/m$^2$), output for the front side and a setting value thereof are adjusted will be described.

Figure 7:
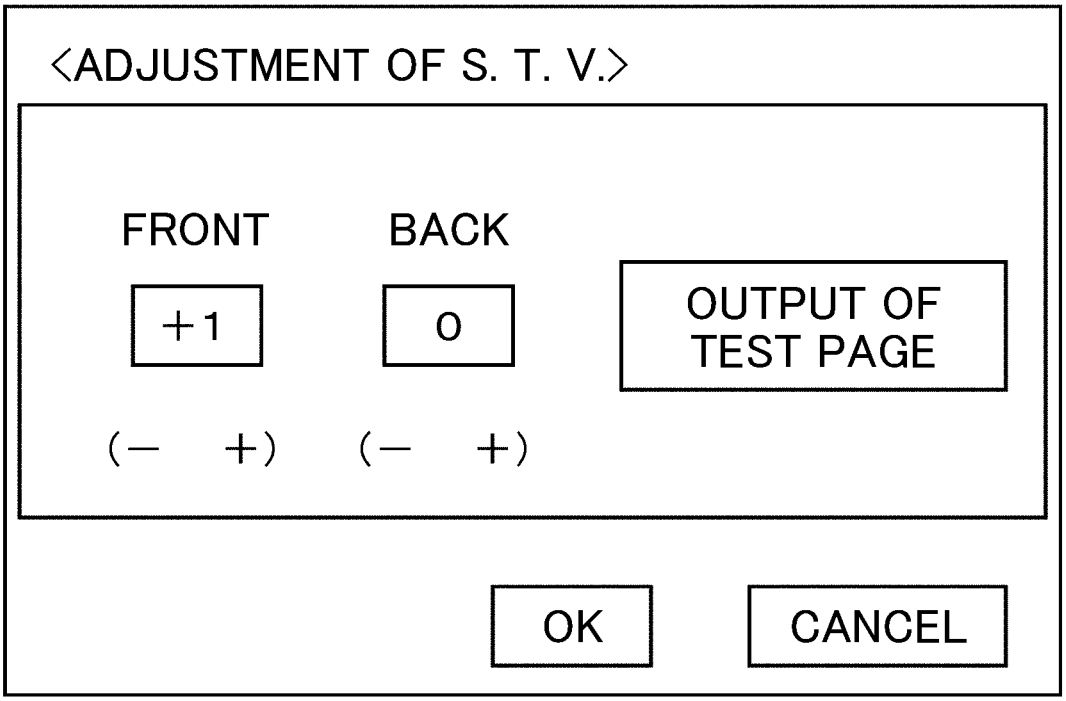
FIG. 7 is a schematic view showing an example of a setting screen in the operation in the secondary transfer voltage adjusting mode.

First, the thick paper 2 as the kind of the recording material, the A3 size, and the one-side printing are selected, and thereafter, in the <ADJUSTMENT OF SECONDARY TRANSFER VOLTAGE> screen as shown in FIG. 7, an output button of a test page is selected through the operating portion 70 (S102). The image forming apparatus starts an image forming operation of a test page and executes the ATVC during pre-rotation of this image forming operation, so that the voltage-current characteristic of the secondary transfer portion is acquired (S103). Incidentally, the pre-rotation refers to a period in which rotation of the photosensitive drum is started as a preparation operation before the image forming operation and in which successive rising and adjustment of various voltages are carried out. Further, the test page refers to a page on which the adjusting image chart including the above-described plurality of pattern images is formed.

Next, the secondary transfer voltage Vtr (output value) to be applied to the pattern image in the adjusting image chart is calculated and is outputted while being switched for the recording material (S104). A calculating method of the output value will be specifically described using the explanatory view of FIG. 8 as an example. Incidentally, the following (1) and (2) correspond to (1) and (2), respectively, of FIG. 8.

(1) First, from the voltage-current characteristic of the secondary transfer portion acquired by the ATVC, a voltage value Vb (for example, 2700 V) necessary to cause the target transfer current Itarget (for example, 37 μA) to flow through the secondary transfer portion depending on a condition selected in S101 is calculated. Further, the recording material part voltage Vp (for example, 1500 V) is acquired by making reference to the table data.

(2) The adjusting amount (value) ΔV is set at 0 V, and then the secondary transfer voltage Vtr (for example, 4200 V) which is Vb (2700 V)+Vp (1500 V)+ΔV (0 V) is acquired, and the secondary transfer voltage Vtr at this time is used as a center value Vtr (def). Further, on a side of the pattern image with the center value Vtr (def), 0 is indicated as a value corresponding to the adjusting amount ΔV.

Figure 8:
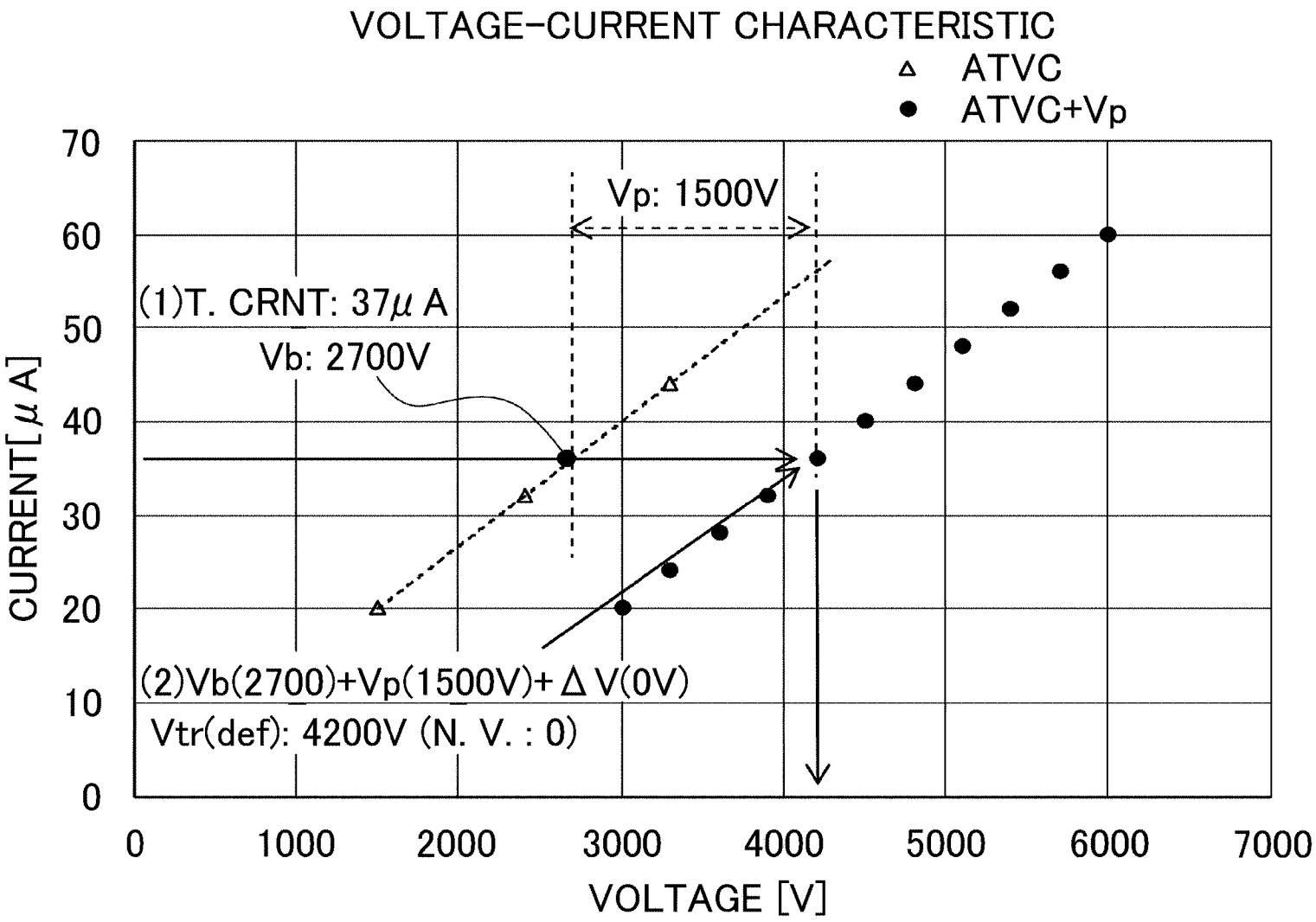
FIG. 8 is a graph for illustrating setting of a transfer voltage in the operation in the secondary transfer voltage adjusting mode according to the embodiment.

As regards the secondary transfer voltage Vtr corresponding to a numerical value indicated on a side of each pattern image, in an example of FIG. 8, 100 V is regarded as "1" (numerical value), and secondary transfer voltages Vtr corresponding to numerical values from −5 to +5 are applied by being switched for each pattern image on the recording material. That is, with respect to the center value of 4200 V (def: numerical value:0) acquired by the ATVC, the secondary transfer voltage is outputted by being applied in a switching manner correspondingly to the associated numerical value such that 3700 V is the numerical value of −5 and 4700 V is the numerical value of +5.

The outputted adjusting image chart is set in the first reading portion 80 by the user, and the user executes a start of reading on a display screen of the operating portion 70 (S105). By this, density data of respective pattern images of secondary-color blue solid images, single-color black solid images, and single-color black halftone images on the adjusting image chart are acquired (S106).

Based on the above-acquired density data, the pattern images (numerical values from −5 to +5) with an optimum transfer property and adjusting values ΔV at that time are acquired in accordance with the following (a) and (b) as a predetermined selection standard (S107).

(a) From the acquired data in S106, a pattern image in which densities of the secondary-color blue solid images and the single-color black solid images are stable is extracted.

(b) Of the secondary-color blue solid images extracted in (a), a smallest adjusting value (at which the voltage is smallest) is selected.

The pattern image is outputted by changing the secondary transfer voltage Vtr to a low voltage side and a high-voltage side with respect to the center value (def) acquired by the ATVC. At this time, when the secondary transfer voltage Vtr is decreased, at a portion where a toner amount is large as in the secondary-color blue solid image, the toner (image) in a sufficient amount cannot be transferred onto the recording material S, so that a transfer void image occurs. On the other hand, when the secondary transfer voltage Vtr is increased, at a portion where the toner amount is small as in the single-color halftone image, the toner polarity is partially reversed and the toner is returned to the intermediary transfer belt 44*b* by the influence of abnormal (electric) discharge of the toner, so that a white dropout image which is roughened occurs.

In the operation in the semi-automatic adjusting mode in the comparison example, in order that the white dropout image which is roughened does not occur at the above-described halftone portion, the set value is automatically selected on the basis of the above-described selection standard of (a) and (b). Further, in the comparison example, in a predetermined place on the display screen shown in FIG. 7, after the adjusting image chart is read by the image reading portion 80, the numerical value (front side: +1 in the example of FIG. 7) automatically selected in (b) is displayed. The user checks the outputted adjusting image chart and discriminates whether or not there is no problem in transfer property of the pattern image corresponding to the displayed numerical value (S108).

In the case where there is no problem (YES of S108), "OK" is selected on the screen of FIG. 7, so that the result thereof is reflected in a set value of the front side of the thick paper 2 (121-152 g/m$^2$) (S109). Thereafter, in the case where the user uses the recording material of this section, this adjusting value ΔV is reflected.

On the other hand, in S108, in the case where the user desires to make the set value larger or smaller than an automatically selected value (NO of S108), the adjusting value can be manually changed by changing the numerical value with "+" or "−" button on the screen of FIG. 7 (S110). By this, the transfer property can be adjusted to a transfer property of a desired pattern image. After the adjusting value is manually changed, by selecting the "OK" on the screen of FIG. 7, in the current operation in the adjusting mode, the result of the selection is reflected in the set value of the front side of the thick paper 2 (121-152 g/m$^2$) (S109).

In the case of the above-described comparison example, in an operation in a semi-automatic adjusting mode, when the user desires to change the automatically selected value, after the user carries out the reading of the adjusting image chart by the image reading portion 80 every time, there is a need that the user manually inputs the automatically selected value again. Thus, in the case where the operation in which the user manually changes the adjusting value again when the user executes the adjusting mode is performed every time, it takes time to perform the transfer voltage adjusting operation, so that operation efficiency lowers. Therefore, in this embodiment, the operation in the semi-automatic adjusting mode is performed in the following manner.

[Semi-Automatic Adjusting Mode of this Embodiment]

Also, in the operation in the adjusting mode of the secondary transfer voltage in this embodiment, similarly as in the above-described comparison example, the operation is performed in the semi-automatic adjusting mode including the test chart output mode. However, this embodiment is different from the comparison example in that an offset value is settable for the adjusting value automatically selected in the operation in the semi-automatic adjusting mode. In other words, the adjusting value is changeable.

That is, also in the case of the operation in the semi-automatic adjusting mode in this embodiment, a plurality of images (test images) corresponding to a plurality of test voltages on the adjusting image chart outputted in the operation in test chart output mode are detected by the image reading portion 80. Then, on the basis of a detection result, the adjusting value which is set in advance by a predetermined selection standard, i.e., which is for the transfer voltage set by the ATVC is automatically selected. The predetermined selection standard is the same as the predetermined selection standard described above in (a) and (b).

Thus, the adjusting value selected in the operation in the semi-automatic adjusting mode is capable of being displayed on the display screen of the display portion 70*a*. The operating portion 70 is capable of inputting a correcting value, i.e., an offset value, for the adjusting value displayed at the display portion 70*a*. Further, in the operation in the semi-automatic adjusting mode after the offset value is inputted through the operating portion 70, the controller 30 causes the display portion 70*a* to display an adjusting value selected by the predetermined selection standard and an adjusting value on the basis of the offset value. That is, in the operation in the semi-automatic adjusting mode, this offset value is automatically reflected in the adjusting value selected by the predetermined selection standard.

In other words, the operating portion 70 is capable of changing the above-described adjusting value, and in the operation in the semi-automatic adjusting mode after the adjusting value is changed through the operating portion 70, the controller 30 automatically reflects the change of the adjusting value in the adjusting value selected by the predetermined selection standard. In the following, this will be specifically described using parts (a) and (b) of FIG. 9.

Figure 6:
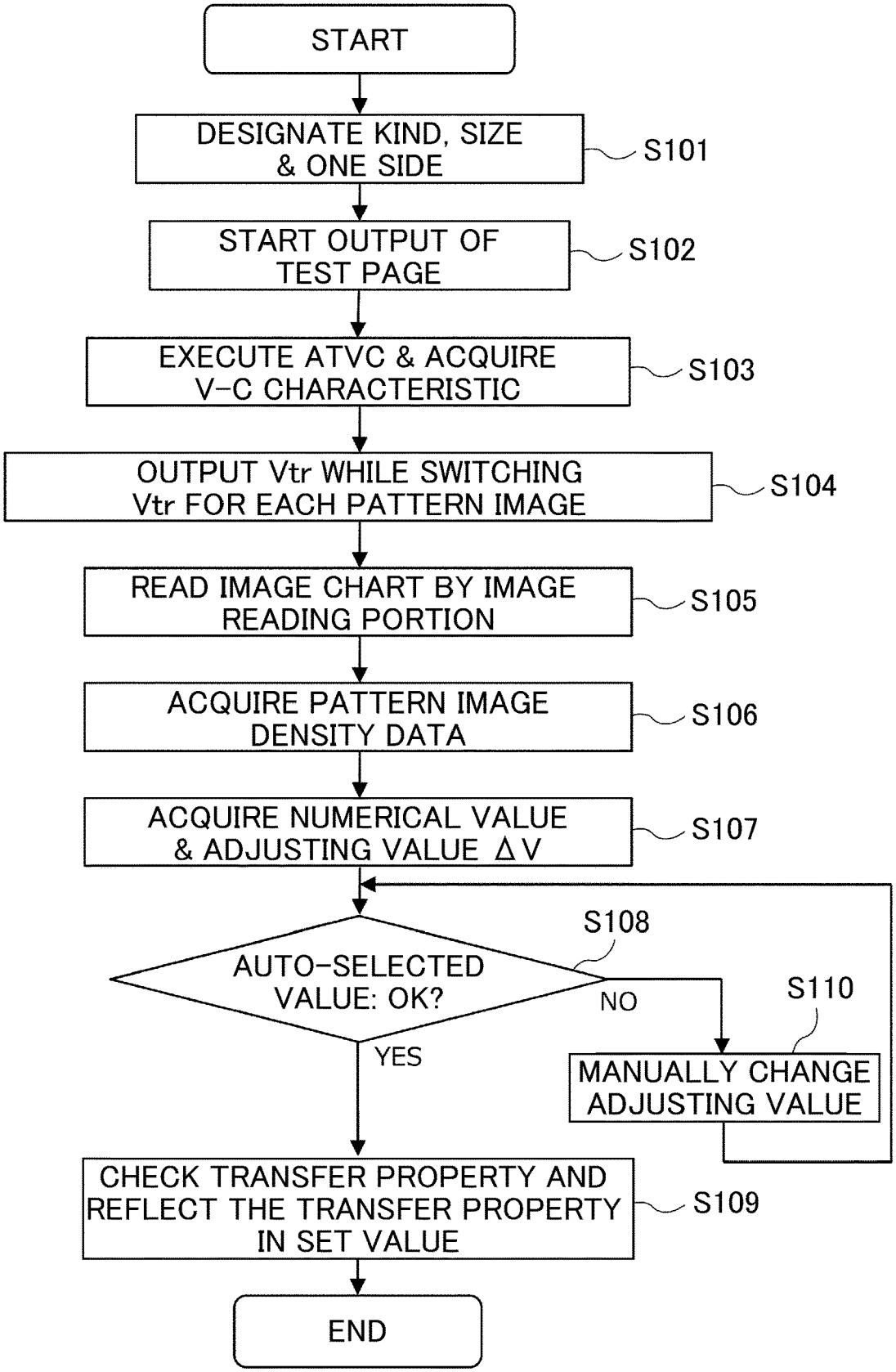
FIG. 6 is a flowchart of an operation in a secondary transfer voltage adjusting mode according to a comparison example.

In part (a) of FIG. 9, S101 to S109 are the same as S101 to S109, respectively, of the above-described FIG. 6.

In S110 of FIG. 6, the automatically selected adjusting value was manually corrected in each case. On the other hand, in this embodiment, in the operation in the semi-automatic adjusting mode, a <ADJUSTMENT OF SECONDARY TRANSFER VOLTAGE ADJUSTMENT OF OFFSET VALUE> screen in an operation in a user mode as shown in FIG. 10 is displayed at the display portion 70*a*. Then, the offset value for the adjusting value (automatically selected value) selected by automatic adjustment is capable of being inputted (S111 of part (a) of FIG. 9).

For example, in the case where the automatically selected value displayed on the display screen in S108 is "+1", when the user wishes to realize the transfer property of the pattern image of +2, on the adjusting screen of the offset value of FIG. 10, the offset value of +1 for the automatically selected value is inputted (S111). In the case of the example of FIG. 10, the user presses the "+" button once. By this, after this, the adjusting value offset by "+" to the original automatically selected value is to be displayed after the adjusting image chart is read. That is, the controller 30 automatically reflects the offset value inputted through the operating portion 70 in the adjusting value (automatically selected value) automatically selected in a subsequent operation in the semi-automatic adjusting mode, and causes the display portion 70*a* to display the resultant automatically selected value.

Specifically, as shown in part (b) of FIG. 9, in the operation in the semi-automatic adjusting mode after the above-described offset value is inputted, the adjusting image chart is printed (S201), and this adjusting image chart is read by the image reading portion 80. At this time, the controller 30 automatically selects the adjusting value in which the above-described offset value is reflected (S202). Then, the sequence is returned to S108 of part (a) of FIG. 9, and this value is displayed at the display portion 70*a*.

Further, in this embodiment, such an offset value is capable of being inputted depending on the kind of the recording material. That is, the operating portion 70 is capable of inputting the offset value for the adjusting value for each kind of the recording material (for example, for each paper kind). In this case, in S101 of part (a) of FIG. 9, the user selects the kind and the size of the recording material intended to be adjusted and whether the printing is one-side printing or double-side printing through the operating portion 70, but in this embodiment, the above-described offset value is made effective only for the selected recording material. Then, in the case where the operation in the semi-automatic adjusting mode is executed for the recording material which is the same in kind as the recording material for which the offset value is inputted, the controller 30 automatically reflects the above-described offset value in the adjusting value selected by the predetermined selection standard. For example, in the above-described setting (for example, initial adjustment) of the above-described offset value and in subsequent setting, for each section of the recording material (in this case, the thick paper 2) selected in S101, the offset value is applied during execution of the operation in the adjusting mode of the secondary transfer voltage. Further, on the adjusting screen of the semi-automatic adjusting mode, the value offset by "+1" to the automatically selected value is always displayed.

Incidentally, in the case where the operation in the semi-automatic adjusting mode is executed for the recording material different in kind from the recording material for which the offset value is inputted, the above-described offset value is not automatically reflected in the adjusting value selected by the predetermined selection standard.

Thus, in the case of this embodiment, when the user desires to correct the adjusting value automatically selected in the operation in the semi-automatic adjusting mode, after the automatic adjustment, it is possible to eliminate manual re-input of the adjusting value by the user every time or to reduce the frequency of the re-input. For this reason, efficiency of the transfer voltage adjusting operation can be improved.

OTHER EMBODIMENTS

In the above-described embodiment, the reflection of the offset value was enabled for each kind of the recording material. However, the offset value may also be made applicable to all the kinds of the recording materials. That is, in the operation in the semi-automatic adjusting mode after the offset value is inputted through the operating portion 70, the controller 30 may also automatically reflect the offset value in the adjusting value selected by the predetermined selection standard irrespective of the kind of the recording material. For example, in the case where the offset value is made "+1" when the kind of the recording material is the "thick paper 2", the operation in the adjusting mode of the secondary transfer voltage is subsequently performed for "plain paper", and at the time, in the operation in the semi-automatic adjusting mode, the value offset by "+1" to the automatically selected value is displayed.

By this, there is no need to set the offset value for each of individual recording materials, so that by a single operation, all the recording materials can be subjected to correction to the automatically selected value in the operation in the semi-automatic adjusting mode, and thus efficiency of the adjustment of the transfer voltage can be enhanced.

Incidentally, whether an object in which the offset value for the adjusting value in the operation in the semi-automatic adjusting mode is reflected is set for each kind of the recording material or for all the kinds of recording materials may also be made selectable in the operation in the user mode or in the operation in the service mode.

Further, the above-described offset value for the adjusting value may also be reflected for each of log-in users. Further, in the above-described embodiment, description was made so that the above-described offset value for the adjusting value can be inputted on the adjusting screen of the user mode, but the input of the offset value is enabled only in the operation in the service mode or the like, so that an input person of the offset value may also be restricted.

Further, in the above-described explanation, the offset value was reflected in the adjusting value as it was, but the present invention is not limited thereto. On the basis of the last correction result (the last offset value), the user discriminates that higher transfer voltage setting is preferred and then changed the adjusting value to a positive (+) side. For example, in the case where the offset value of "+2" is inputted through the operating portion 70, in a subsequent operation and later, the value offset by "+1" may be displayed. That is, a value obtained by subjecting the offset value to calculation with a predetermined coefficient may be reflected as an offset value in the subsequent operation and later.

Further, in the above-described embodiment, the case where the density detecting portion capable of detecting the density of the outputted image is the image reading portion 80 was described. However, if the density detecting portion is a device capable of reading density data of the outputted image, the density detecting portion may also be a dedicated device, other than the image reading portion 80, capable of reading only the density data, for example. For example, the density detecting portion may be the calorimeter of a manual operation type as described in JP-A 2013-37185.

In the above-described embodiment, in the constitution of the intermediary transfer type using the intermediary transfer belt, the adjustment of the secondary transfer voltage in the secondary transfer portion was described. However, the present invention is not limited thereto, but may also be applicable to a constitution in which a direct transfer type in which the toner image is directly transferred from the photosensitive drum onto the recording material is employed and in which a primary transfer roller using, for example, the ion-conductive material is used as the transfer member. That is, the primary transfer roller forms a primary transfer portion, between itself and the photosensitive drum, for transferring the toner image from the photosensitive drum onto the recording material. Then, by applying a primary transfer voltage to the primary transfer roller, the toner image is transferred from the photosensitive drum onto the recording material. Also, in such a primary transfer portion, similarly as in the above-described secondary transfer portion, the resistance value of the primary transfer roller changes between in the initial stage and after the endurance. For this reason, the adjustment of the transfer voltage similar to the adjustment in the above-described embodiments is applicable to adjustment of the primary transfer voltage.

Further, the present invention is not limited to the image forming apparatus 1 of the tandem type using the intermediary transfer type, but may also be an image forming apparatus of another type. Further, the image forming apparatus is not limited to the full-color image forming apparatus, but may also be a monochromatic image forming apparatus or a single-color image forming apparatus. Or, the present invention can be carried out in various purposes such as printers, various printing machines, copying machines, facsimile machines, and multi-function machines.

According to the present invention, efficiency enhancement of adjustment of the transfer voltage can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-059835 filed on Mar. 31, 2021, which is hereby incorporated by reference herein in its entirety.

What is claimed is:

1. An image forming apparatus comprising:

an image forming portion configured to form a toner image;

an image bearing member configured to bear the toner image formed by said image forming portion;

a transfer member configured to transfer the toner image from said image bearing member onto a recording material;

a voltage source configured to apply a transfer voltage to said transfer member;

a density detecting portion configured to detect information on a density of an image formed on the recording material;

a display portion capable of displaying information;

a controller capable of executing an operation in an adjusting mode in which a test chart for adjusting the transfer voltage is outputted, wherein the test chart is formed by transferring a predetermined test image from said image bearing member onto the recording material under application of a plurality of different test voltages to said transfer member; and an operating portion to which information is capable of being manually inputted, wherein said controller causes said display portion to display setting information for the transfer voltage to be set for a period during transfer based on a detection result of the test chart detected by said density detecting portion in the adjusting mode, allows reception of correcting information to correct the setting information displayed on said display portion from said operating portion, and determines the transfer voltage set for the period during transfer on the basis of the correcting information inputted from said operating portion, and wherein, during execution of a current operation in the adjusting mode, said controller causes said display portion to display the setting information for the transfer voltage to be set for the period during transfer based on the detecting result of the test chart detected by said density detecting portion outputted in the current operation in the adjusting mode and the correcting information inputted from said operating portion in a last operation in the adjusting mode.

2. The image forming apparatus according to claim 1, wherein said controller is configured to receive the correcting information to correct the setting information displayed on said display portion during execution of the current operation in the adjusting mode.

3. The image forming apparatus according to claim 1, wherein said controller is configured to determine whether or not to display the transfer voltage to be displayed in the current operation in the adjusting mode based on the correcting information inputted in the last operation in the adjusting mode for each of users logged into said image forming apparatus.

4. The image forming apparatus according to claim 1, wherein said controller is configured to determine whether or not to display the transfer voltage to be displayed in the current operation in the adjusting mode based on the correcting information inputted in the last operation in the adjusting mode for each kind of the recording material onto which the test chart is outputted in the adjusting mode.

5. The image forming apparatus according to claim 1, wherein when a kind of the recording material onto which the test chart is outputted in the last operation in the adjusting mode is a first kind and a kind of the recording material onto which the test chart is outputted in the current operation in the adjusting mode is a second kind different from the first kind, said controller is configured to display the transfer voltage to be displayed in the current operation in the adjusting mode based on the correcting information inputted in the last operation in the adjusting mode.

6. The image forming apparatus according to claim 1, wherein said controller is configured to selectively determine whether or not to display the transfer voltage to be displayed in the current operation in the adjusting mode based on the correcting information inputted in the last operation in the adjusting mode.

* * * * *